US005813139A

United States Patent [19]

Lillicotch

[11] Patent Number: 5,813,139

[45] Date of Patent: Sep. 29, 1998

[54] METHOD AND DEVICE FOR DRYING CARPET

[76] Inventor: Ryan C. Lillicotch, 3347 Annandale Rd., Falls Church, Va. 22047

[21] Appl. No.: 818,154

[22] Filed: Mar. 14, 1997

[51] Int. Cl.[6] ..... F26B 9/00

[52] U.S. Cl. ..... 34/618; 34/621; 34/444

[58] Field of Search ..... 34/343, 442, 621, 34/622, 240, 444, 618, 619

[56] References Cited

U.S. PATENT DOCUMENTS

| | | | |
|---|---|---|---|
| 39,128 | 7/1863 | Dick | 294/121 |
| 179,090 | 6/1876 | Barnes | 81/3.45 |
| 196,226 | 10/1877 | Havell | 81/3.45 |
| 2,649,614 | 8/1953 | Holt | 452/176 |
| 4,983,087 | 1/1991 | Mierek | 414/24.5 |
| 5,174,048 | 12/1992 | Shero | 34/444 |
| 5,257,467 | 11/1993 | White | 34/151 |

*Primary Examiner*—Harold Joyce
*Assistant Examiner*—Pamela A. O'Connor
*Attorney, Agent, or Firm*—Richard C. Litman

[57] ABSTRACT

A method for facilitating the drying of carpet More specifically, the present invention relates to using a coiled corkscrew-like device to lift and hold wet wall-to-wall carpeting and padding off of the floor so that air may be blown under the carpet to dry the carpet. The present invention includes a coiled rod, a handle, and a mounting washer. The handle and the rod are welded to opposing sides of the mounting washer. The rod is made from 3/16 of an inch diameter stainless steel and is sharpened to a needle point at the terminal end. The sharpened end of the device is used to puncture a small hole in the carpet. The handle is then rotated about the axis of the coiled rod which raises the carpet off of the floor. Once all of the carpet has been lifted from the floor, one side of the carpet is opened and an air blower is installed to blow air under the carpet. The device is capable of lifting approximately nine square yards of carpeting and padding. The number of devices needed to raise the carpet will depend on the grade of carpet and the amount of water in the carpet.

1 Claim, 4 Drawing Sheets

METHOD AND DEVICE FOR DRYING CARPET

BACKGROUND OF THE INVENTION

1. Field of the Invention

The present invention relates generally to a method and a device used for facilitating the drying of carpet. More specifically, the present invention relates to a tool which can be used to lift and hold wet wall-to-wall carpeting and padding off of the floor so that air may be blown under the carpet to dry the carpet.

2. Description of Related Art

When carpeting becomes wet either due to cleaning of the carpet or due to pools of water collecting on the carpet, the carpet should be dried as quickly as possible in order to minimize water damage and to prevent mildew from forming. Wall-to-wall carpeting presents a special problem since the carpet is attached to the floor and its removal would require large amounts of labor and can damage the carpet. A large number of fans are typically used to blow air over the upper surface of the carpeting, but no matter how many fans are used this is a slow and inefficient process.

The purpose of the present invention is to assist and shorten the process used to dry wet wall-to-wall carpeting. Not only does the present invention shorten the drying time, but it also eliminates sixty six percent of the air blowers needed to dry the carpet. Since the carpet does not need to be taken up in this new drying process, it prevents the carpet from stretching and reduces the labor used in drying the carpet. By creating an air pocket under the wet carpeting and padding, the device of the present invention allows circulating air to reach a much larger surface area of the carpeting and padding which will greatly facilitate the drying process.

The following patents are examples of devices related to the present invention.

U.S. Pat. No. 39,128, issued on Jul. 7, 1863, to James M. Dick, and U.S. Pat. No. 4,983,087, issued on Jan. 8, 1991, to James V. Mierek describe tools with helical spring-like components for lifting bales of hay. U.S. Pat. No. 179,090, issued on Jun. 27, 1876, to Joshua Barnes, and U.S. Pat. No. 196,226, issued on Oct. 16, 1877, to George Havell describe corkscrews with a handle and a sharpened end point. U.S. Pat. No. 2,649,614, issued on Aug. 25, 1953, to Raymond B. Holt describes a helical wire device which is used as a means for closing the filling opening in prepared poultry. None of the above patents describe either a device or a method capable of drying carpeting, as does the present invention.

U.S. Pat. No. 5,257,467, issued on Nov. 2, 1993, to Lawrence W. White describes a carpet drying apparatus which blows air underneath a carpet to facilitate drying. The patent to White describes a device which uses high powered air blowers to force air under the carpet. The problem with this method is that unless extremely high powered blowers are used, the force of the air will not be enough to lift the entire surface of the wet carpet off of the floor which makes the process inefficient. The present invention solves this problem by using a device which holds the carpet off of the floor so that a smaller number of air blowers may be used to achieve a more efficient result. If a smaller number of lower power air blowers are used then there is a savings in energy. Also by lifting the entire surface of the carpet off of the floor the amount of surface area the circulating air reaches is increased, thereby greatly increasing the efficiency of the drying process.

None of the above inventions and patents, taken either singularly or in combination, is seen to describe the instant invention as claimed. Thus a method and device for drying carpet solving the aforementioned problems is desired.

SUMMARY OF THE INVENTION

The present invention relates generally to a method and a device used for facilitating the drying of carpet. More specifically, the present invention relates to a coiled corkscrew-like tool which can be used to lift and hold wet wall-to-wall carpeting and padding off of the floor so that air may be blown under the carpet to dry the carpet.

The present invention includes a coiled rod, a handle, and a mounting washer. The handle and the rod are welded to opposing sides of the mounting washer. The rod is made from 3/16 of an inch diameter stainless steel and is sharpened to a needle point at the terminal end.

The sharpened end of the device is used to puncture a small hole in the carpet and padding. The handle is then rotated about the axis of the coiled rod which raises the carpet and padding off of the floor. Once all of the carpet has been lifted from the floor, one side of the carpet is opened and an air blower is installed to blow air under the carpet. The device is capable of lifting approximately nine square yards of carpeting and padding. The number of devices needed to raise the carpet will depend on the grade of carpet and the amount of water in the carpet.

Accordingly, it is a principal object of the invention to provide a simple device and a method of using the device which will facilitate the drying of carpeting.

It is another object of the invention to provide a method and a device for drying wall-to-wall carpet which improves and shortens the process commonly used to dry wet wall-to-wall carpeting.

It is a further object of the invention to provide a method and a device for drying wall-to-wall carpet which greatly reduces the number of air blowers needed to dry the carpet.

Still another object of the invention is to provide a method and a device for drying wall-to-wall carpet which eliminates the need for taking up the carpeting, thereby reducing labor and preventing the carpet from being stretched to the point of ruin.

It is an object of the invention to provide improved elements and arrangements thereof in a method and device for drying carpet for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
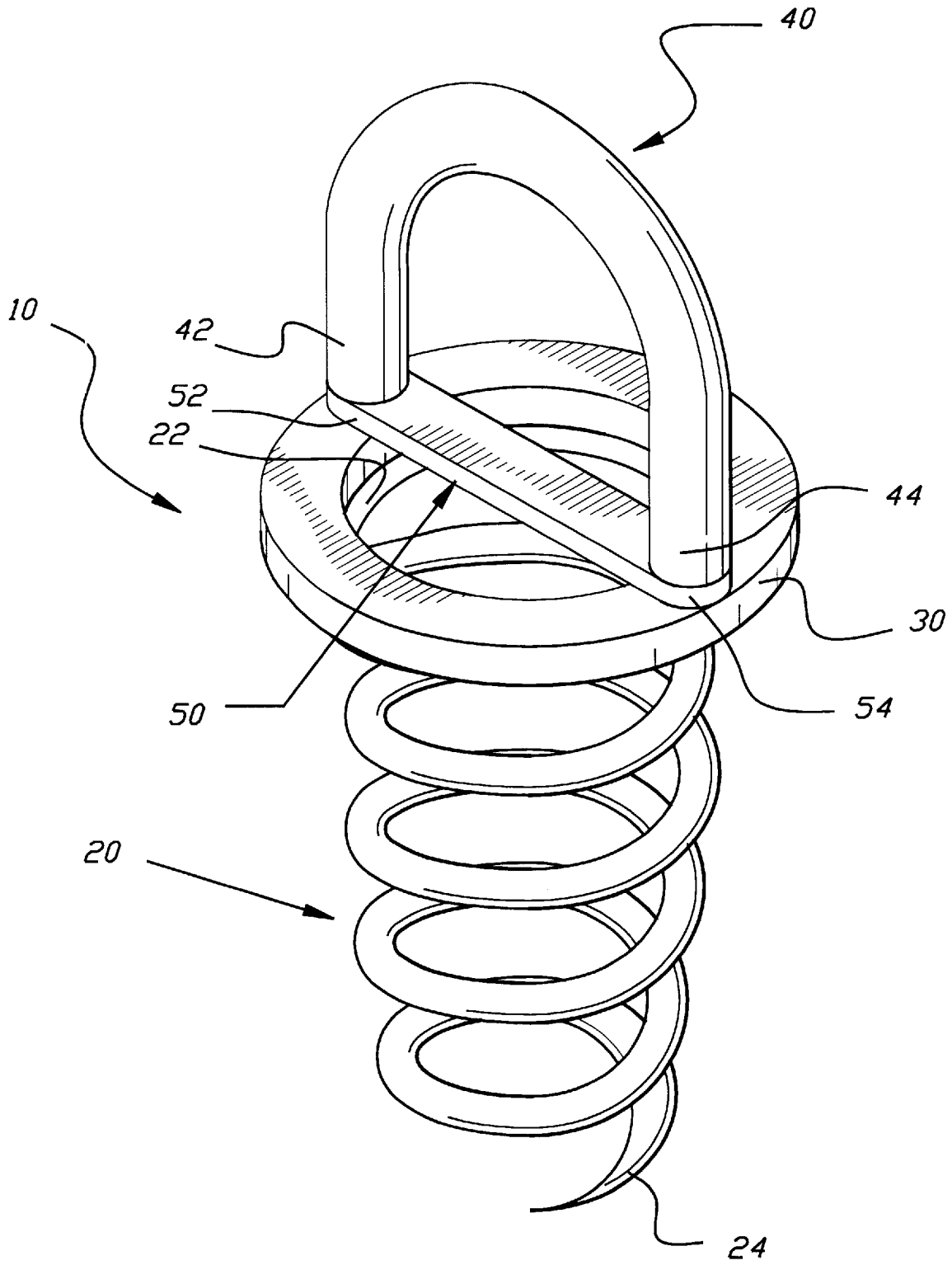
FIG. 1 is a perspective view of a device to assist in the drying of carpeting according to the present invention.
Figure 2:
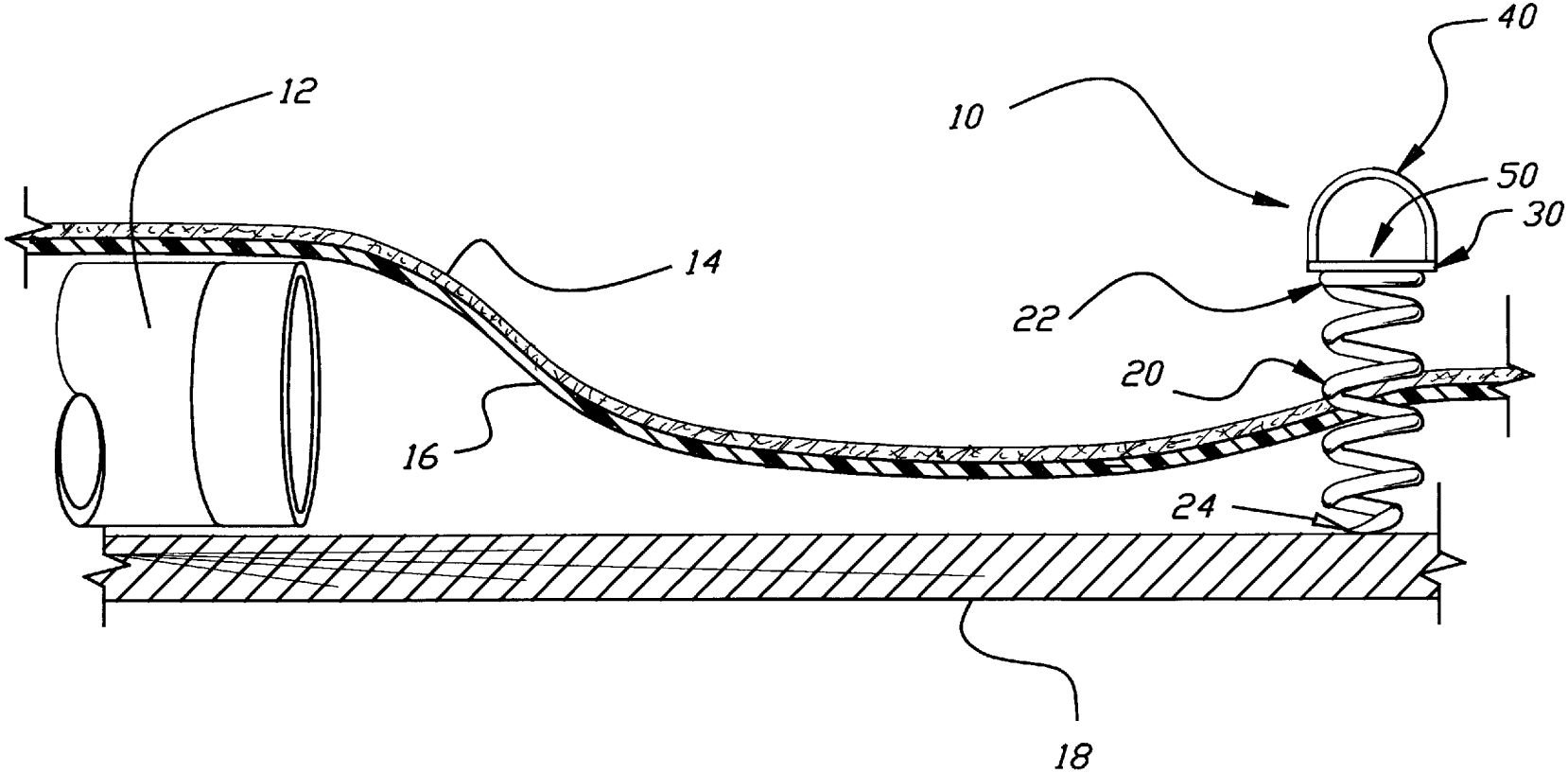
FIG. 2 is a cross-sectional, environmental view of a device being used in combination with a hot air blower to dry wall-to-wall carpeting.
Figure 3:
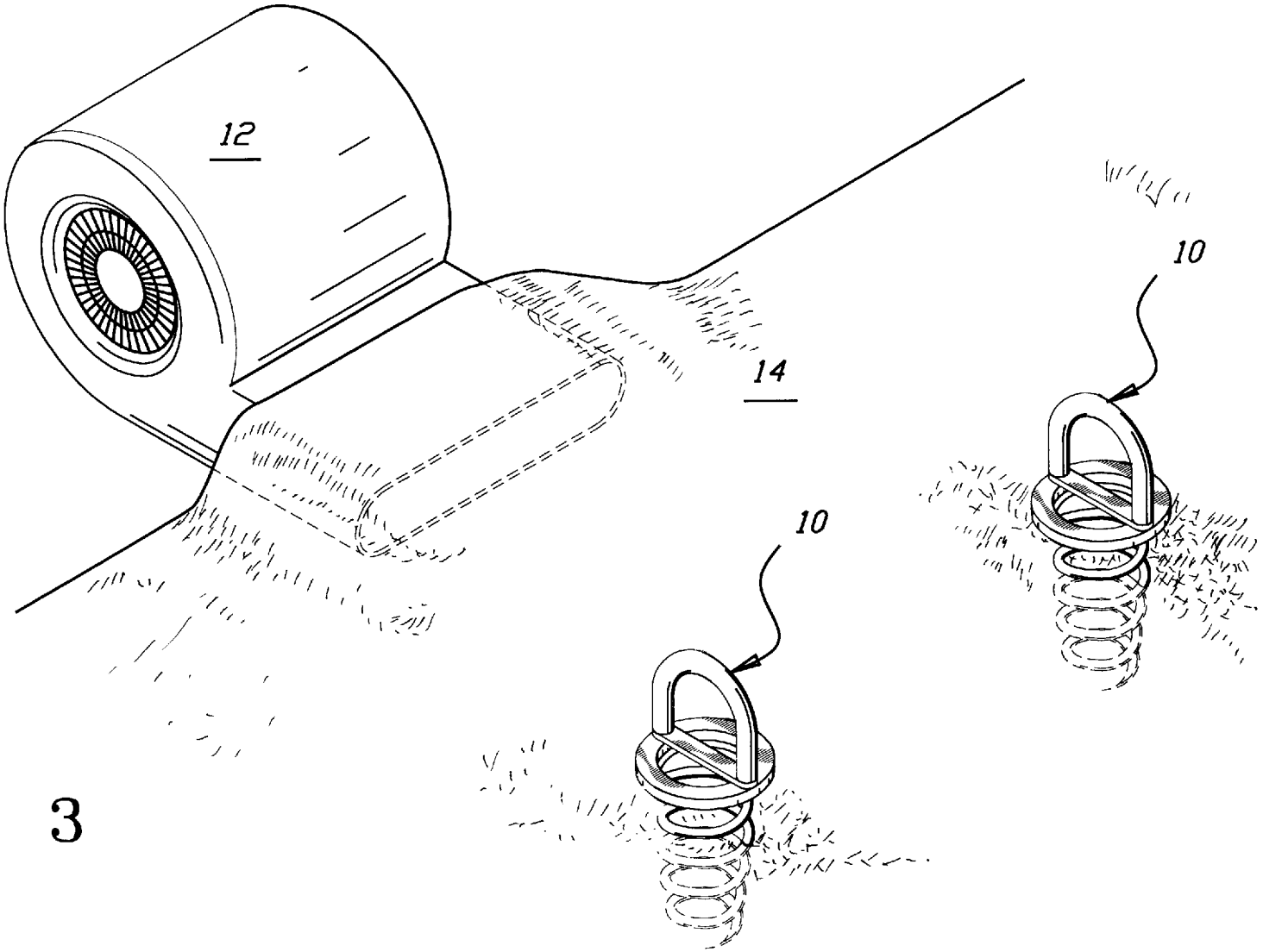
FIG. 3 is an environmental, perspective view of a pair of devices being used in combination with a hot air blower to dry wall-to-wall carpeting.
Figure 4:
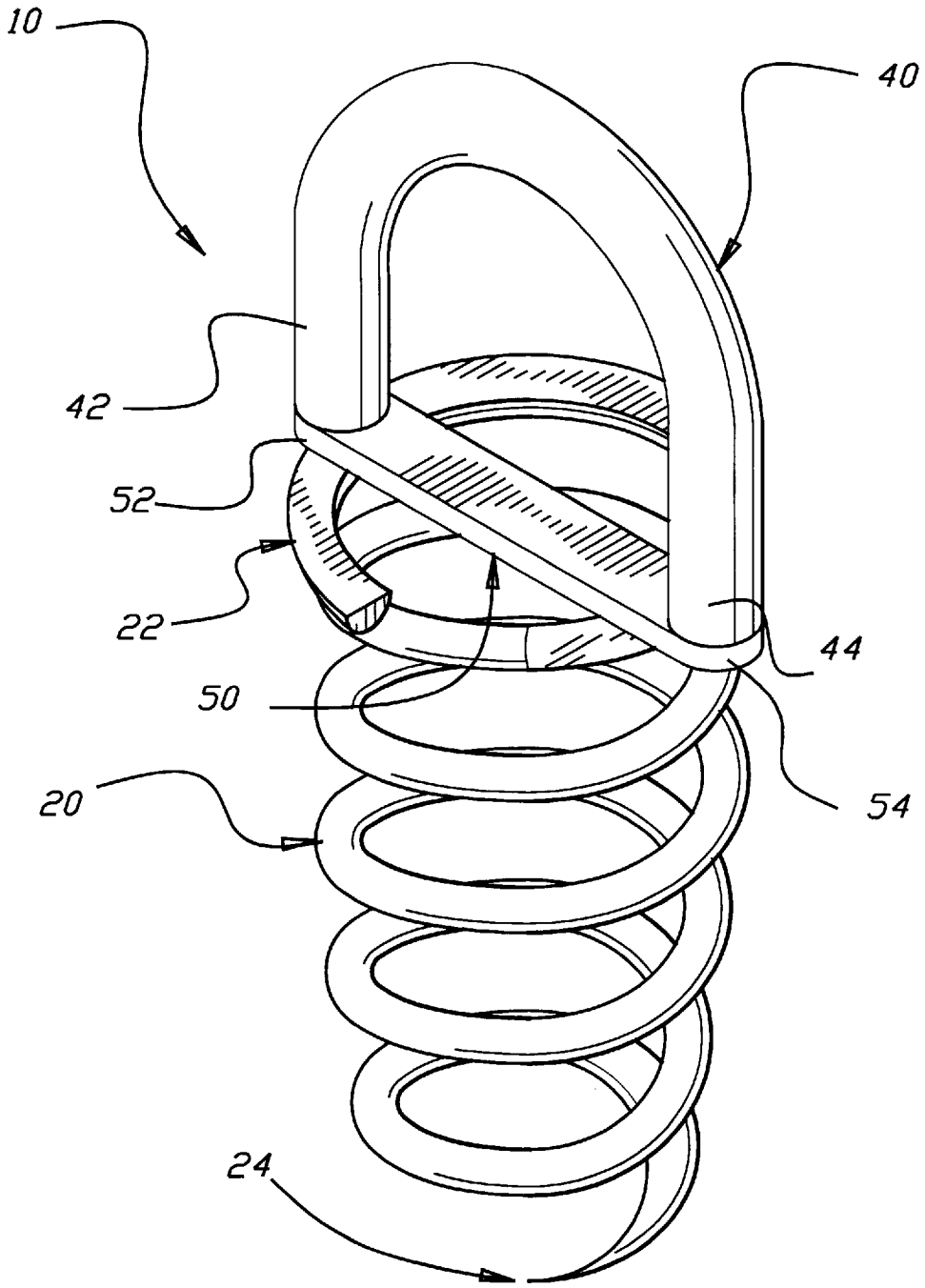
FIG. 4 is a perspective view of a second embodiment of the device which assists in the drying of wall-to-wall carpeting according to the present invention.

Referring generally to FIGS. 1 through 4, the present invention relates to a tool 10 which can be used to lift and hold wet wall-to-wall carpeting 14 and padding 16 off of the floor 18 so that air may be blown under the carpet to dry the carpet. FIG. 1 shows the first embodiment of the present invention which includes a coiled rod 20, a handle 40, and a mounting washer 30. The second embodiment of the present invention is shown in FIG. 4, and includes only a coiled rod 20 and a handle 40.

Referring to the first embodiment as shown in FIG. 1, the handle 40 and the rod 20 are welded to opposing sides of the mounting washer 30. The rod 20 is coiled to form a substantially circular portion at the first end 22 which sits flush with the washer 30 and is welded thereto. The handle 40 is preferably U-shaped with a first end 42 and a second end 44 which are welded to the washer 30. The handle 40 may also include a structural member 50 which is either integral to the handle 40, as in the case of a "D" ring handle, or is welded thereto. The first end 52 of the structural member 50 is connected to the first end 42 of the handle 40 and the second end 54 of the structural member 50 is connected to the second end 44 of the handle 40.

Preferably, the rod 20 is made from 3/16 of an inch diameter stainless steel and is sharpened to a needle point at the terminal end 24. The 3/16 of an inch diameter stainless steel is preferred because it makes only a small hole in the carpet 14 during use, yet it is rigid enough to hold the wet carpet 14 off the ground 18 without substantially flexing under the weight of the wet carpet 14. Preferably, the rod 20 is coiled to form a cylindrically shaped two inch diameter helix, although other shaped coils may alternatively be used. The washer 30 is a two inch round stainless steel washer.

The sharpened end 24 of the device 10 is used to puncture a small hole in the carpet 14 and padding 16. The handle 40 is then rotated about the axis of the coiled rod 20 which raises the carpet 14 and padding 16 off of the floor 18, as shown in FIGS. 2 and 3. Once most or all of the carpet 14 and padding 16 has been lifted from the floor 18, one side of the carpet 14 and padding 16 is opened and an air blower 12 is installed to blow air under the carpet 14 and padding 16. By creating an air pocket under the wet carpeting 14 and padding 16, the device allows circulating air to reach a much larger surface area of the carpeting and padding which will greatly facilitate the drying process. If air blowers are also used on the top surface of the carpeting 14, the drying process will be further expedited.

The device 10 is capable of lifting approximately nine square yards of carpeting and padding. The number of devices needed to raise the carpet 14 and padding 16 will depend on the grade of carpet and padding and the amount of water therein.

FIG. 4 shows a second embodiment of the present invention which is essentially the same as the first embodiment except the washer 30 is not included in this design. In this embodiment the surface of the first end 22 of the rod 20 that mates with the handle 40 is manufactured to form a flat surface to receive the first end 42 and the second end 44 of the handle. The flat surface at the first end 22 of the rod 20 allows the ends, 42 and 44, of the handle 40 to sit flush with the rod 20 to allow the formation of a rigid welded between the handle 40 and the rod 20.

It is to be understood that the present invention is not limited to the embodiments described above, but encompasses any and all embodiments within the scope of the following claims.

I claim:

1. A method for drying carpet using a device including a substantially U-shaped handle having a first end and a second end, and a coiled rod having a first end rigidly connected to the first end and the second end of the handle and a sharpened second end, said method comprising the steps of:

piercing a hole in the carpet with said sharpened second end of said rod;

rotating said handle such that the hole travels along said rod; and blowing air under the carpet.

* * * * *